US007565746B2

(12) United States Patent
Yeh

(10) Patent No.: US 7,565,746 B2
(45) Date of Patent: Jul. 28, 2009

(54) HAIRDRESSING SCISSORS

(75) Inventor: Wen-Ya Yeh, 15F-2, No. 18, Chorng Shyue Road, Tainan City (TW) 70156

(73) Assignee: Wen-Ya Yeh, Tainan (TW)

( * ) Notice: Subject to any disclaimer, the term of this patent is extended or adjusted under 35 U.S.C. 154(b) by 253 days.

(21) Appl. No.: 11/212,056

(22) Filed: Aug. 24, 2005

(65) Prior Publication Data

US 2007/0044319 A1 Mar. 1, 2007

(51) Int. Cl.
*B26B 19/22* (2006.01)
*B26B 19/00* (2006.01)
*B26B 13/00* (2006.01)

(52) U.S. Cl. ..... 30/226; 30/227; 30/195; 30/196; 30/197

(58) Field of Classification Search ..... 30/195, 30/196, 197, 226, 227, 254, 260; 24/594.1, 24/594.11, 595.1, 629, 662, 664, 545
See application file for complete search history.

(56) References Cited

U.S. PATENT DOCUMENTS

| | | | | | |
|---|---|---|---|---|---|
| 444,019 | A * | 1/1891 | Richards | 292/17 |
| 2,160,492 | A * | 5/1939 | Cook | 24/578.11 |
| 2,653,686 | A * | 9/1953 | Routt | 52/506.08 |
| 3,191,727 | A * | 6/1965 | Schmeltz et al. | 52/204.593 |
| 4,432,182 | A * | 2/1984 | Addie et al. | 52/480 |
| 4,977,648 | A * | 12/1990 | Eckerud | 24/581.1 |
| 5,184,722 | A * | 2/1993 | Shin et al. | 206/449 |
| 5,775,046 | A * | 7/1998 | Fanger et al. | 52/590.1 |
| 5,957,421 | A * | 9/1999 | Barbour | 248/220.21 |
| 6,192,590 | B1 | 2/2001 | Yeh | |
| 6,234,676 | B1 * | 5/2001 | Galomb et al. | 383/63 |
| 6,353,978 | B1 * | 3/2002 | Kawahara et al. | 24/114.4 |
| 6,434,833 | B1 | 8/2002 | Yeh | |
| 6,634,106 | B2 * | 10/2003 | Yeh | 30/226 |
| 7,010,894 | B1 * | 3/2006 | Cappelle | 52/480 |
| 7,246,416 | B2 * | 7/2007 | Duffy | 24/444 |
| 2004/0233605 | A1 * | 11/2004 | Dabrowski et al. | 361/118 |
| 2005/0226690 | A1 * | 10/2005 | MacDonald et al. | 405/274 |

* cited by examiner

*Primary Examiner*—Ghassem Alie
*Assistant Examiner*—Bharat C Patel
(74) *Attorney, Agent, or Firm*—Alan Kamrath; Kamrath & Associates PA

(57) ABSTRACT

A pair of hairdressing scissors comprises a first blade, a second blade pivotally secured to the first blade. A female connecting portion having a dovetail or T-shaped slot is disposed on at least one of the first and second blades, and a male connecting portion having a dovetail or T-shaped cross section is disposed on at least one of the first and second blades, two pairs of scissors are secured to each other in such a manner that a male connecting portion on a first one of the two pairs of scissors is inserted in a slot of a female connecting portion on a second one of the two pairs of scissors.

4 Claims, 11 Drawing Sheets

HAIRDRESSING SCISSORS

BACKGROUND OF THE INVENTION

1. Field of the Invention

The present invention relates to a pair of hairdressing scissors and, more particularly, to a pair of hairdressing scissors having a connecting device formed on the handle portion thereof, so that plural pairs of such hairdressing scissors can be detachably secured to one another.

2. Description of the Prior Arts

A hairstylist cuts a customer's hair with several techniques, including trimming, thinning, layering, etc. Sometimes, the hairstylist has to hold plural pairs of scissors in the same hand for proceeding with the thinning or layering of the hair to obtain the desired special hairstyle.

During operation of the plural pairs of scissors in the same hand, the user must keep the plural pairs of scissors spaced at regular intervals and operate them with the same operating condition. The plural pairs of scissors must open and close synchronously to obtain a tidy, beautiful hairstyle. However, if the plural pairs of scissors are simply held by the index finger and the thumb of the user, the plural pairs of scissors cannot be operated synchronously due to touchy control of the plural pairs of scissors by the fingers. Thus, the plural pairs of scissors often become skewed to one another, and the spacing therebetween may be different from one another. The haircutting result is adversely affected, and this problem is aggravated if the user is inexperienced. The user often feels pain when operating the plural pairs of scissors in addition to numerous limitations to and difficulties in operation.

U.S. Pat. Nos. 6,192,590 B1, 6,434,833 B1 and 6,634,106 B2 disclose hairdressing scissor assemblies to solve the above-mentioned problems. These hairdressing scissor assemblies can be detachably engaged together so as to allow the hairstylist to use them as freely and easily as using one hairdressing scissor assembly.

The present invention has arisen to mitigate and/or obviate the afore-described disadvantages.

SUMMARY OF THE INVENTION

The primary objective of the present invention is to provide a pair of hairdressing scissors having a connecting device formed on the handle portion thereof, so that plural pairs of such hairdressing scissors can be detachably secured to one another.

A pair of scissors and a connecting device thereof in accordance with the present invention comprises:

a first blade;

a second blade pivotally secured to the first blade;

a female connecting portion disposed on at least one of the first and second blades, the female connecting portion having a slot being T-shaped in cross section; and a male connecting portion disposed on at least one of the first and second blades, the male connecting portion being T-shaped in cross section. Thus, two pairs of scissors are secured to each other in such a manner that a male connecting portion on a first one of the two pairs of scissors is inserted in a slot of a female connecting portion on a second one of the two pairs of scissors.

The female connecting portion and the male connecting portion are two independent parts separated from each other and are disposed at two opposite surfaces of at least one of the first and second blades.

The male connecting portion and the female connecting portion each have a dovetail cross section.

The thickness of the base of the connecting member is larger than the depth of the hole on the handle portion of the hairdressing scissors.

The present invention will become more obvious from the following description when taken in connection with the accompanying drawings, which show, for purpose of illustration only, the preferred embodiments in accordance with the present invention.

DETAILED DESCRIPTION OF THE PREFERRED EMBODIMENTS

Figure 1:
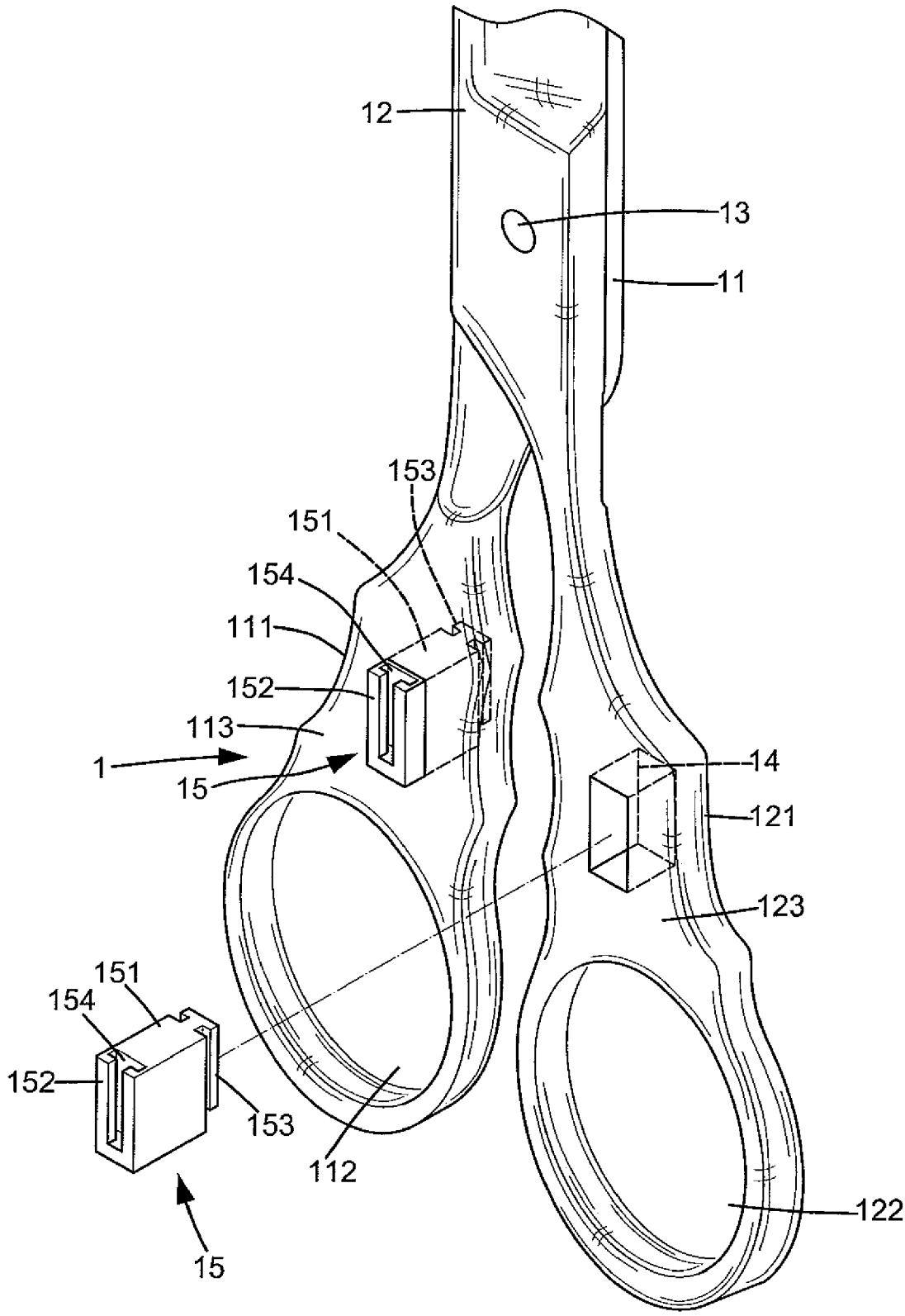
FIG. 1 is a perspective view of a pair of hairdressing scissors in accordance with a first embodiment of the present invention.
Figure 2:
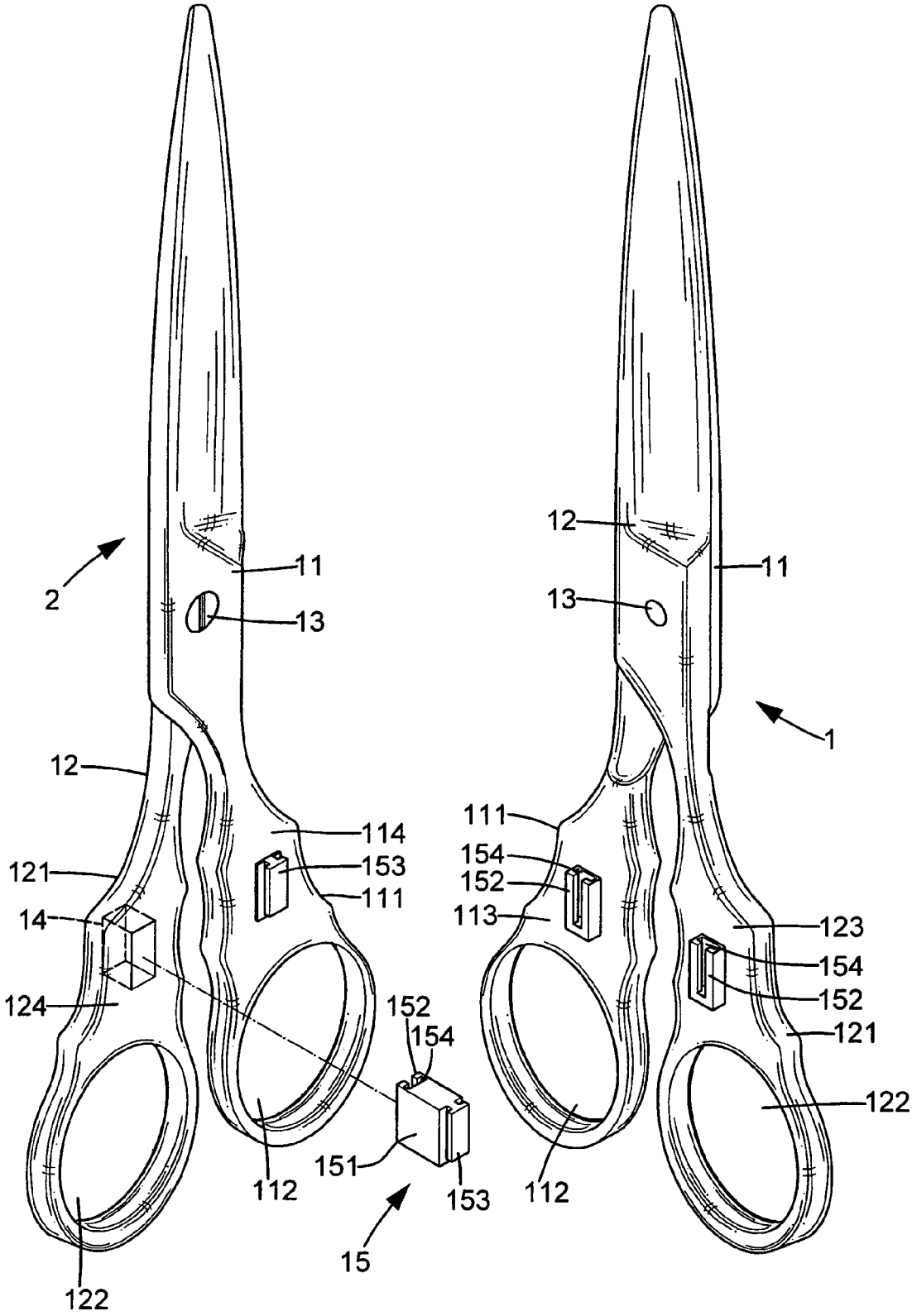
FIG. 2 shows two separated pairs of hairdressing scissors in accordance with the first embodiment of the present invention.
Figure 3:
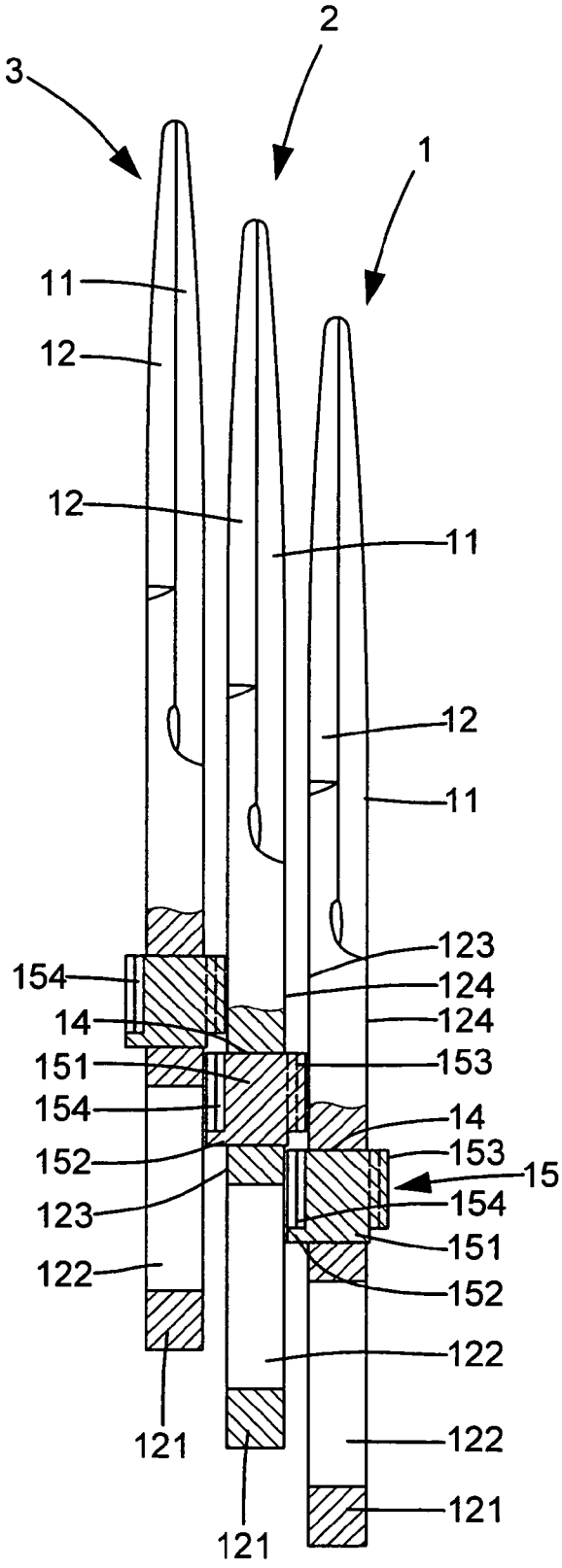
FIG. 3 is a cross sectional view showing three pairs of hairdressing scissors of FIG. 1 prior to being coupled to each other.

FIG. 1 is a perspective view of a pair of hairdressing scissors in accordance with a first embodiment of the present invention. FIG. 2 shows two pairs of hairdressing scissors 1 and 2 in accordance with the first embodiment of the present invention. FIG. 3 is a cross sectional view showing three pairs of hairdressing scissors of FIG. 1 prior to being coupled to each other. The two pairs of hairdressing scissors 1 and 2 each comprise a first blade 11 and a second blade 12. The first and second blades 11 and 12 include connected handle portions 111, 121 each having an opening 112 and 122 for the thumb or index finger of the user. The first and second blades 11, 12 are pivotally connected through a pivot 13.

The handle portions 111 and 121 each have a first surface 113, 123 and a second surface 114, 124 opposite the first surface 113, 123. On at least one of the handle portions 111 and 121 is defined a through-hole 14 running through the first surface 113, 123 and the second surface 114, 124, and in the through-hole 14 is received a connecting member 15. In this embodiment, the through-hole 14 is defined in each of the handle portions 111 and 121.

The connecting member 15 includes a base 151 to be positioned in the through-hole 14, and on two opposite sides of the base 151 are formed a longitudinally extending male connecting portion 152 and a longitudinally extending male connecting portion 153. In this embodiment, the thickness of the base 151 is larger than the depth of the through-hole 14, such that, after the connecting member 15 is received in the through-hole 14, the female connecting portion 152 and the male connecting portion 153 will protrude out of the first surfaces 113 and 123 and the second surfaces 114 and 124 of the handle portions 111 and 121, as shown in FIG. 3.

The female connecting portion 152 has a slot 154 that is T-shaped in cross section and longitudinally extends in a first surface of the base 151. The male connecting portion 153 has a T-shaped cross section conforming to the cross section of the slot 154 and longitudinally extends in a second surface of the base 151.

Figure 4:
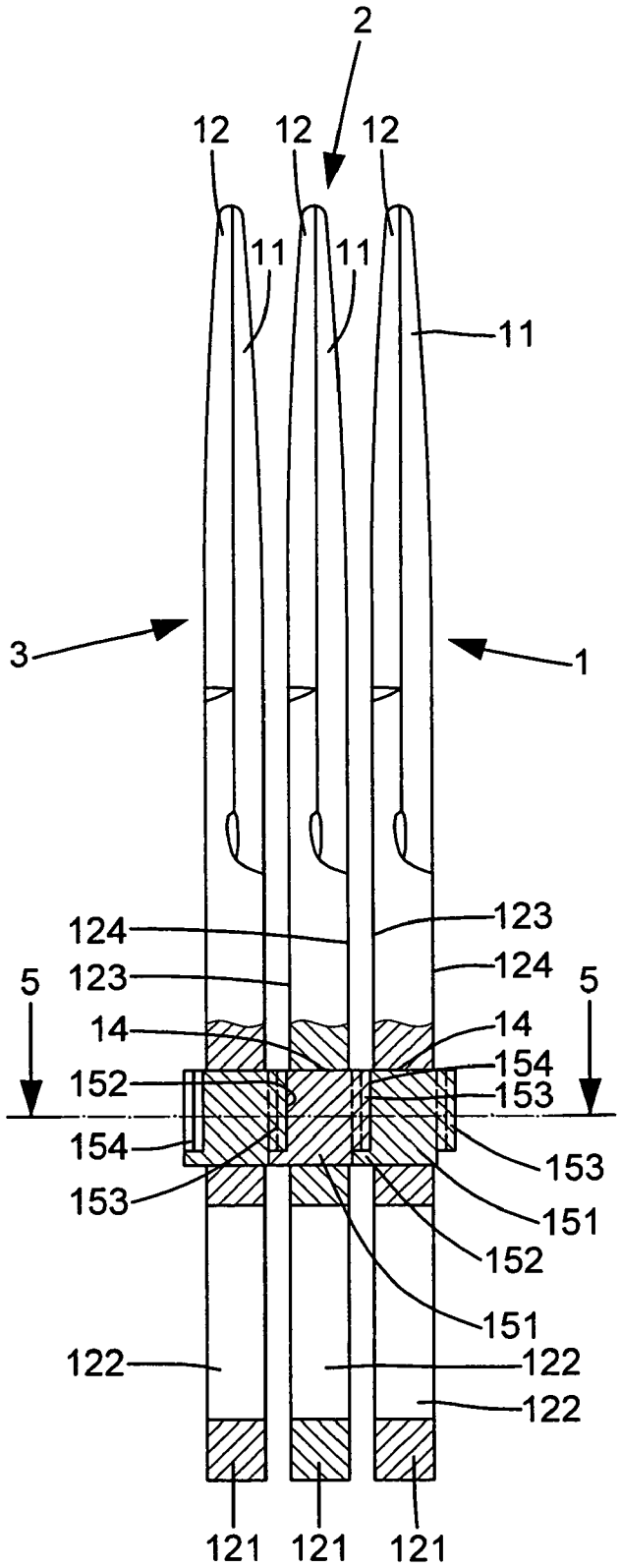
FIG. 4 is a partial cross sectional view showing three pairs of hairdressing scissors of FIG. 1 coupled to one another.
Figure 5:
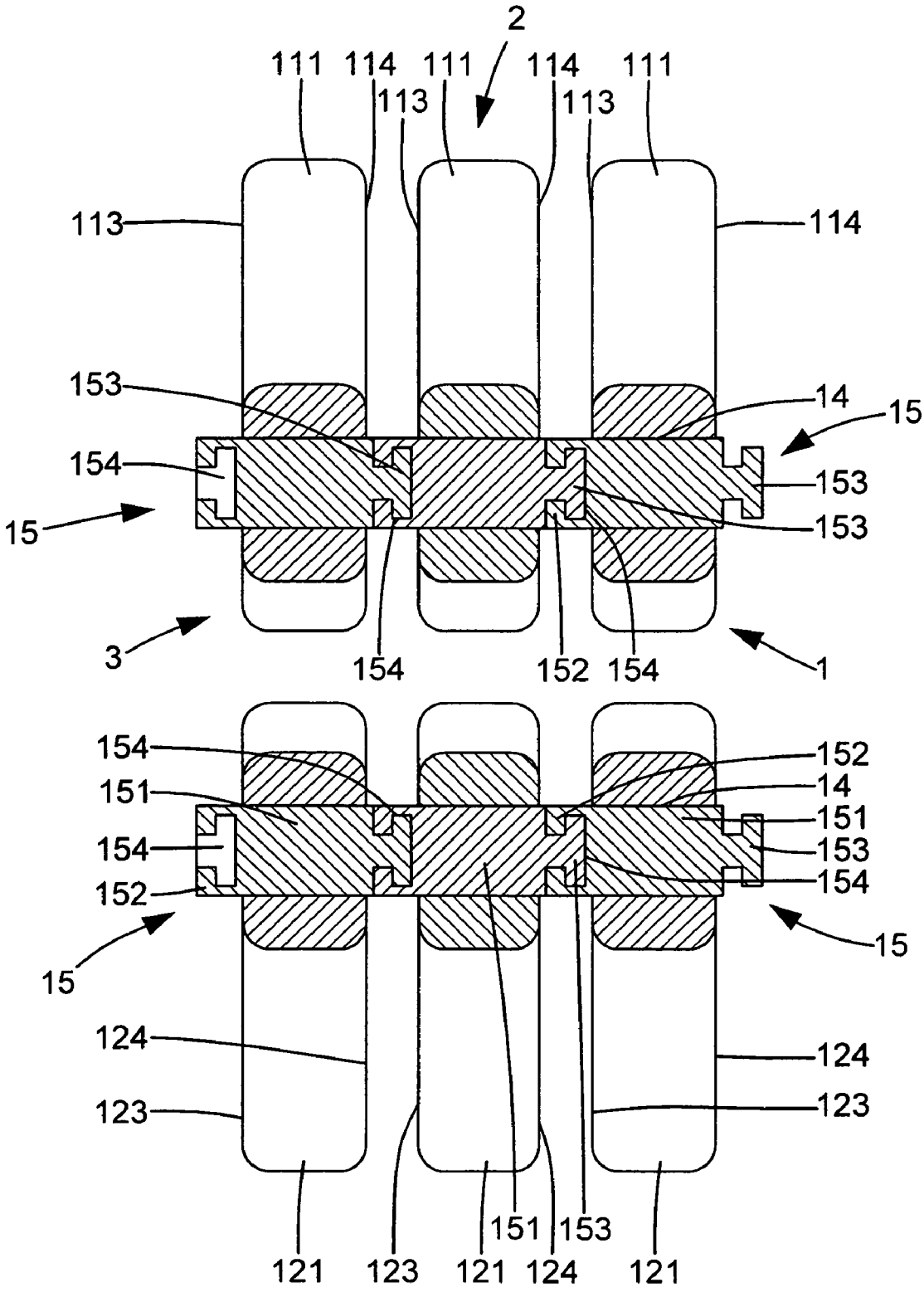
FIG. 5 is a cross section view taken along the line 5-5 of FIG. 4.

As shown in FIGS. 3 and 4, the two pairs of hairdressing scissors 1 and 2 can be coupled together easily by inserting the male connecting portion 153 of the second surfaces 114 and 124 of the second pair of hairdressing scissors 2 into the T-shaped slot 154 on the female connecting portion 152 of the first pair of hairdressing scissors 1. By repeating the above-mentioned steps, a plurality of pairs of scissors 1, 2 and 3 can be detachably locked together, as best shown in FIGS. 4 and 5.

Figure 6:
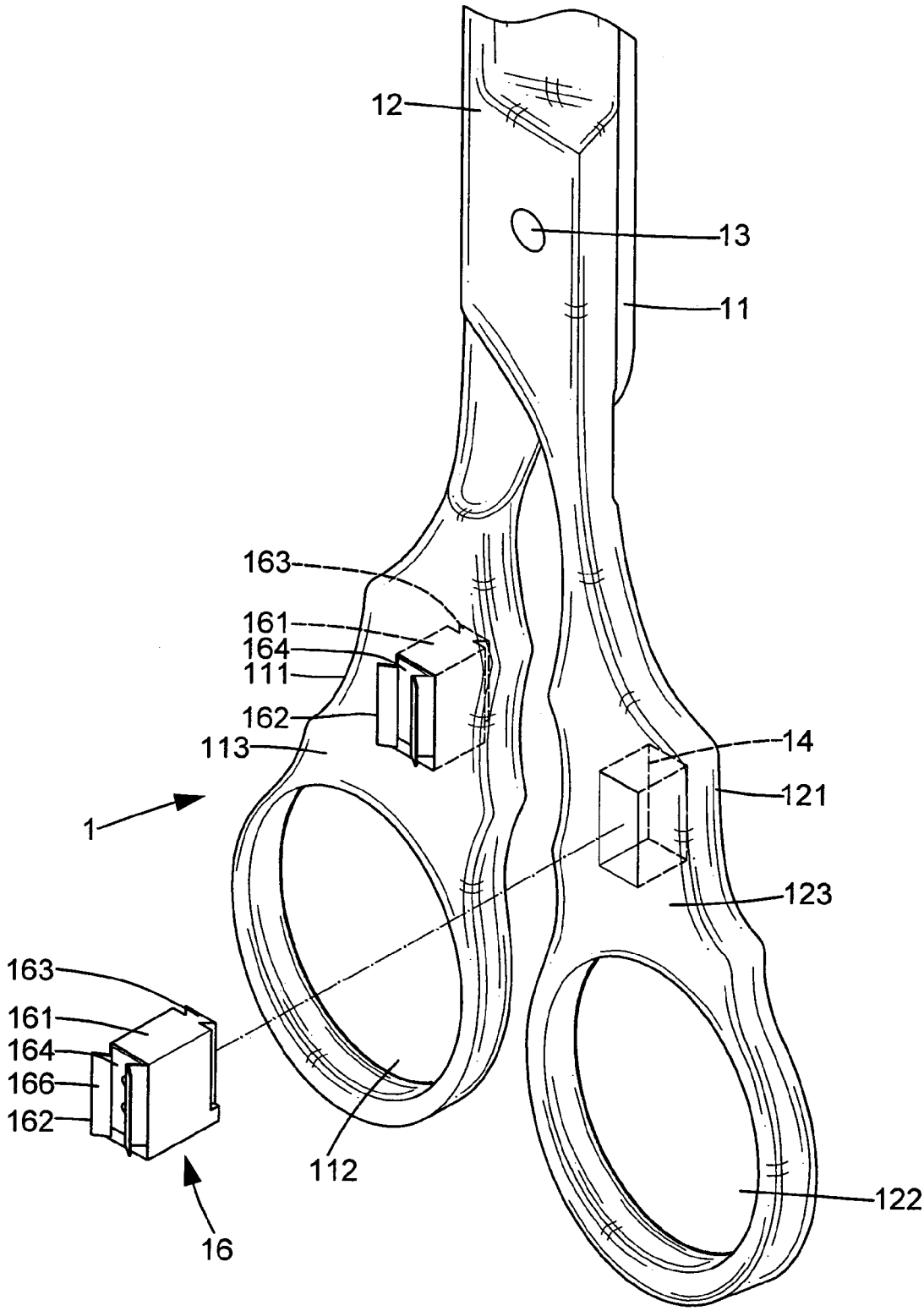
FIG. 6 is a perspective view of a pair of hairdressing scissors in accordance with a second embodiment of the present invention.
Figure 7:
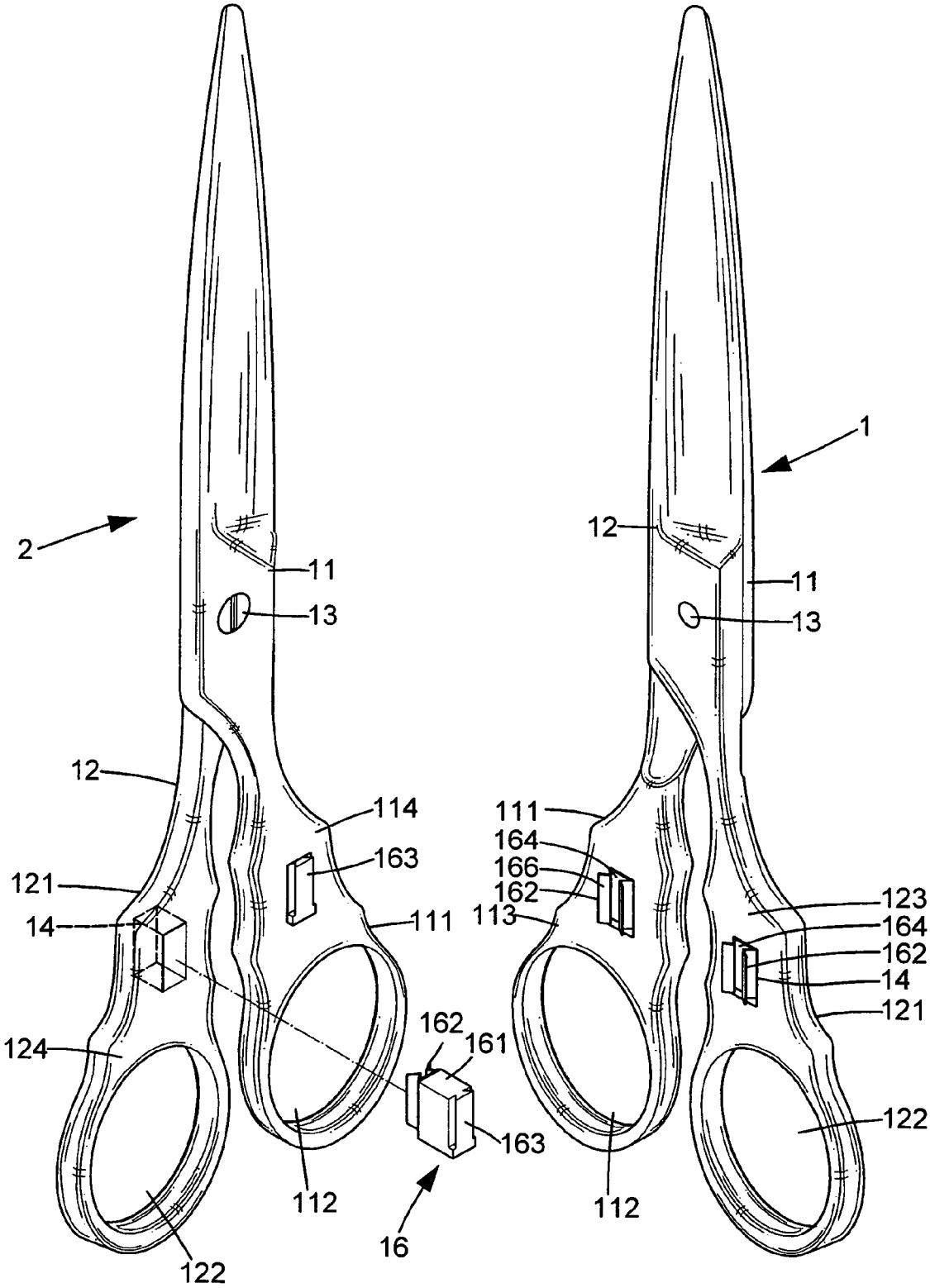
FIG. 7 shows two separated pairs of hairdressing scissors in accordance with the second embodiment of the present invention.
Figure 8:
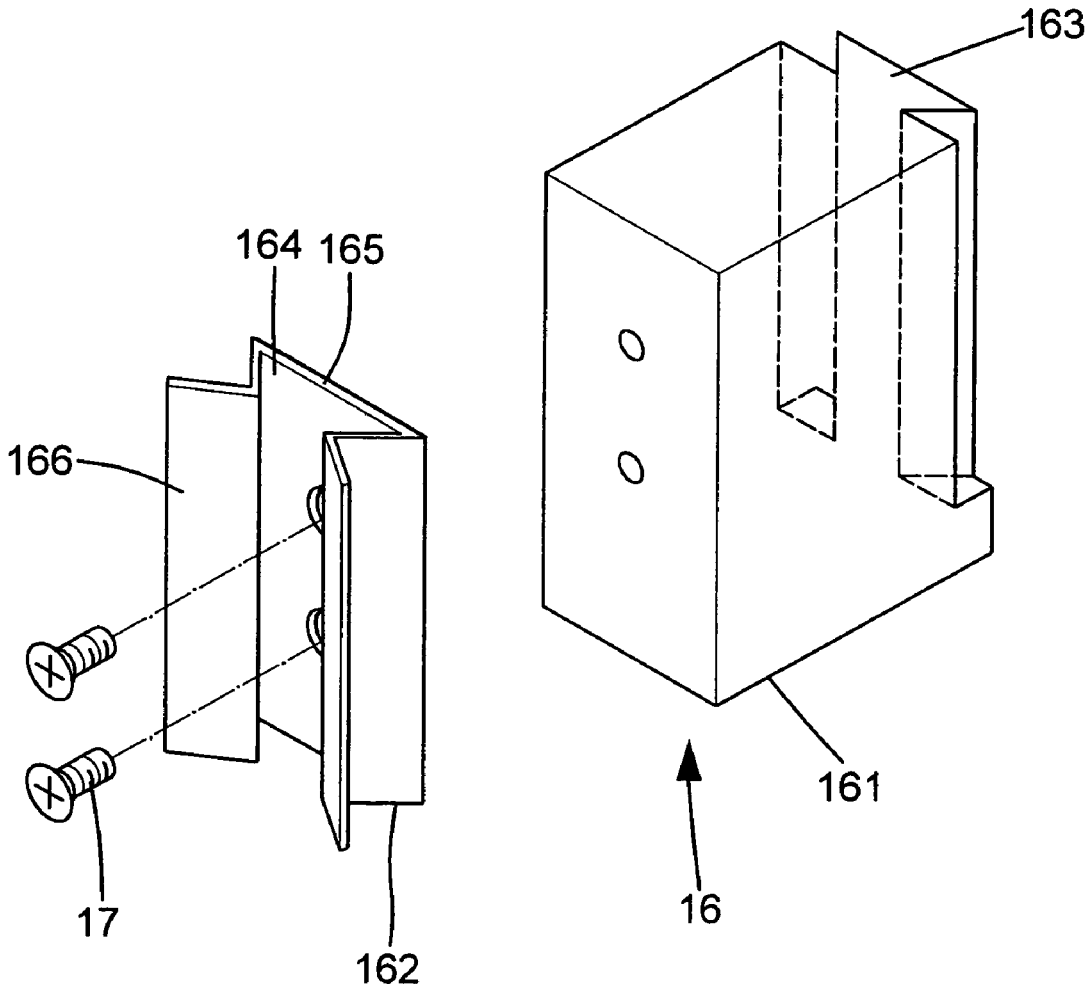
FIG. 8 is an enlarged exploded view of a connecting member of the second embodiment of the present invention.

FIGS. 6, 7 and 8 show a connecting structure for a pair of hairdressing scissors in accordance with a second embodiment of the present invention (components in this embodiment identical or equivalent to the first embodiment are indicated by the same reference numbers). This embodiment is identical to the first embodiment, except that: the abovementioned connecting member 15 has been replaced by a connecting member 16 which also includes a base 161 and is received in the through-hole 14. On two opposite sides of the base 161 are formed a female connecting portion 162 and a male connecting portion 163. After the connecting member 16 is received in the through-hole 14, the female connecting portion 162 and the male connecting portion 163 will protrude out of the first surfaces 113 and 123 and the second surfaces 114 and 124 of the handle portions 111 and 121.

As shown in FIG. 8, the female connecting portion 162 in this embodiment is a clamping piece made of flexible elastic metal detachably fixed to the base 161. This clamping piece includes a bottom 165 that is fixed to a first surface of the base 161 by screws 17 or by other provisions, such as soldering, riveting, nailing and adhesive. On the bottom 165 is formed a dovetail slot 164, and at each outer edge of the bottom 165 is a press portion 166 that is used to adjust the size of the dovetail slot 164. The male connecting portion 163 is formed at a second surface of the base 161 and has dovetail cross sections conforming to the dovetail slot 164.

Figure 9:
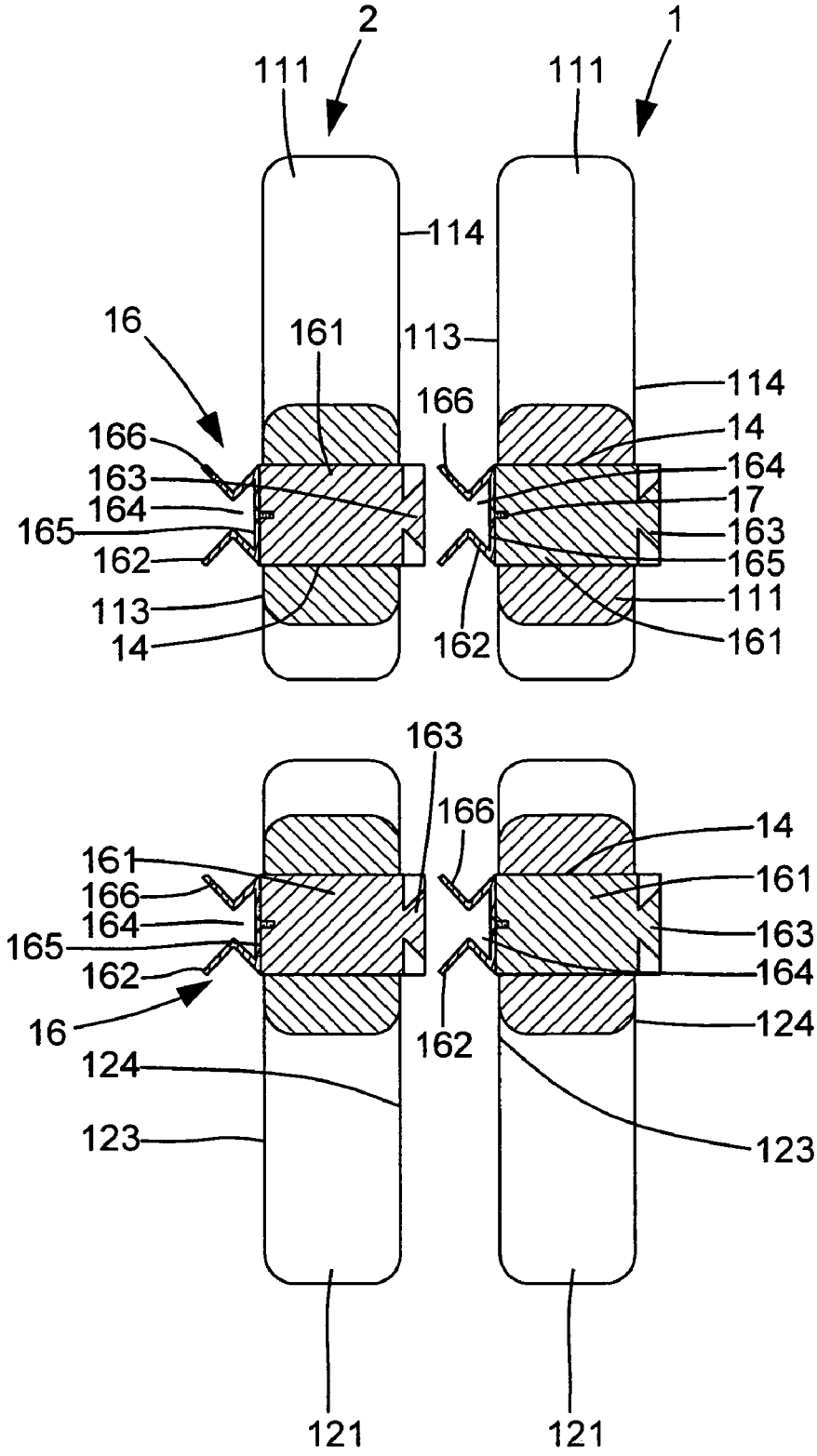
FIG. 9 is a cross sectional view showing the two pairs of hairdressing scissors of FIG. 7 prior to being coupled to each other.
Figure 10:
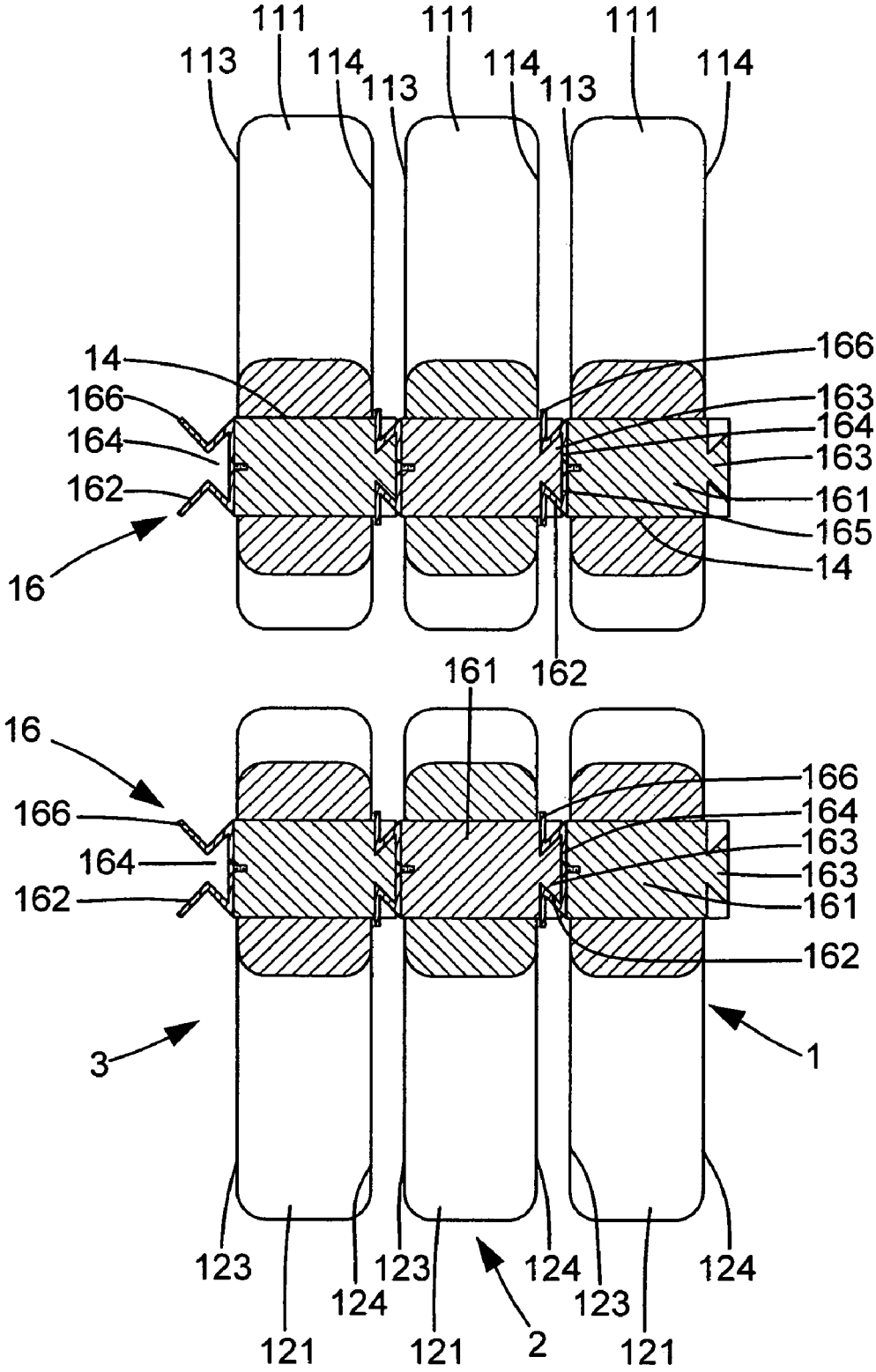
FIG. 10 is a partial cross sectional view showing three pairs of hairdressing scissors of FIG. 7 coupled to one another.

As shown in FIGS. 9 and 10, the two pairs of hairdressing scissors 1 and 2 can be coupled together by inserting the male connecting portion 163 of the second surfaces 114 and 124 of the second pair of hairdressing scissors 2 into the dovetail slot 164 on the female connecting portion 162 of the first pair of hairdressing scissors 1, with the press portions 166 of the elastic female connecting portion 162 flexibly adjusting to the dovetail shape of the male connecting portion 163. Furthermore, the user can press the press portions 166 of the flexible elastic female connecting portion 162, so as to make the dovetail slot 164 of the first pair of hairdressing scissors 1 open, and then press the mail connecting portion 163 of the pair of second hairdressing scissors 2 into the dovetail slot 164 of the first pair of hairdressing scissors 1. The second method allows the two pairs of hairdressing scissors 1 and 2 to be connected more easily. By repeating the above mentioned steps, more pairs of scissors can be detachably locked together.

Figure 11:
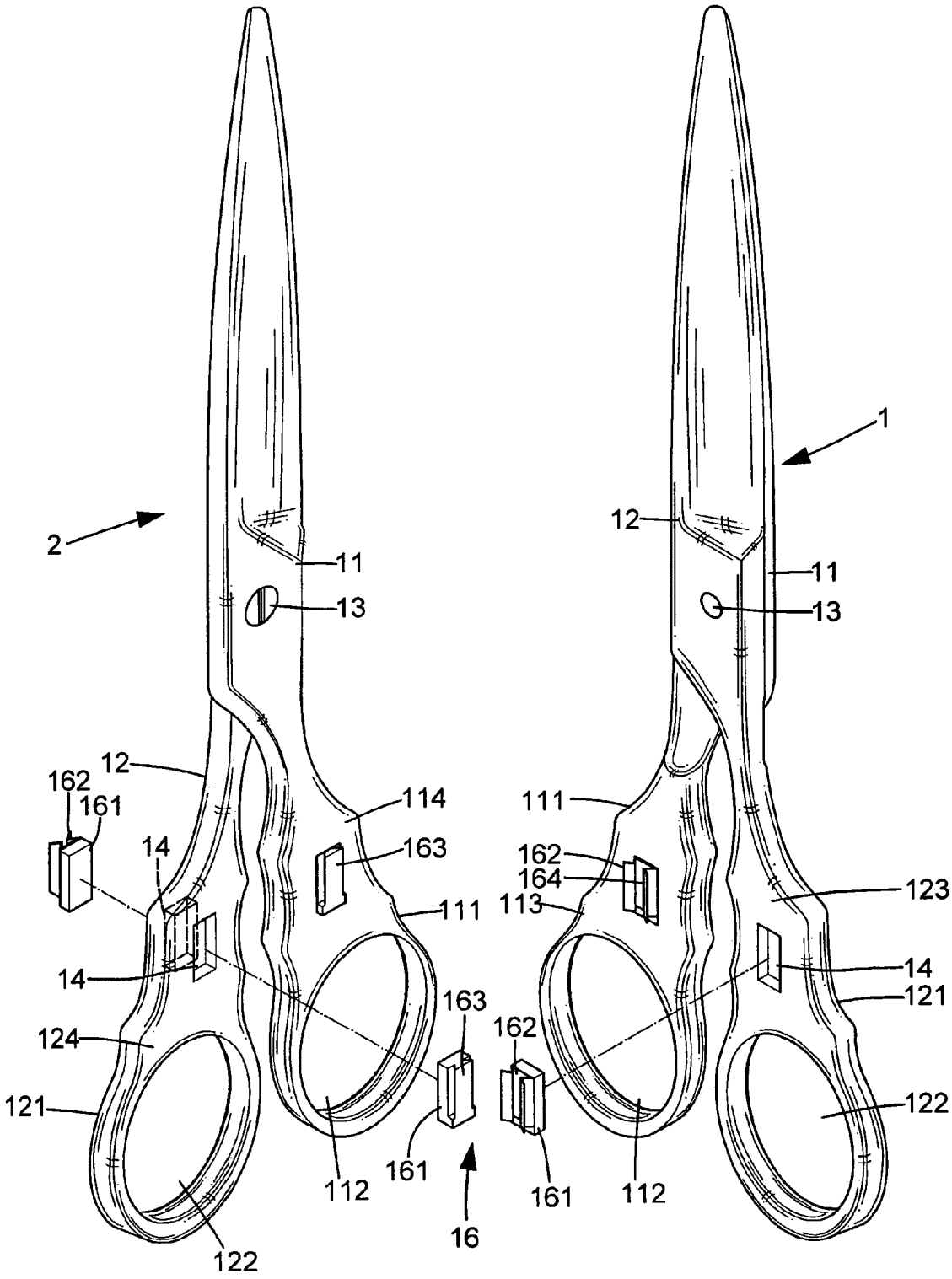
FIG. 11 shows two separated pairs of hairdressing scissors in accordance with another embodiment of the present invention, wherein the female connecting portion and the male connecting portion are two independent parts separate from each other.

It will be noted that the female connecting portion 152 and the male connecting portion 153 of the connecting member 15 in the first embodiment are integral with the base 151, and the connecting member 15 is then received in the through-hole 14. However, the female connecting portion 152 and the male connecting portion 153 also can be separate from each other and are disposed at two opposite surfaces of the handle portion 111,121 of the pair of hairdressing scissors 1, 2. In like manner, the female connecting portion 162 and the male connecting portion 163 of the connecting member 16 in the second embodiment can also be two separate parts each having a base 161, as shown in FIG. 11. The hole 14 is a blind hole formed in each of the opposite surfaces of the handle portion 111, 121 for accommodation of the base 161 of the female connecting portion 162 and the male connecting portion 163.

While various embodiments in accordance with the present invention have been shown and described, it should be clear to those skilled in the art that further embodiments may be made without departing from the scope of the present invention.

What is claimed is:

1. A pair of hairdressing scissors comprising:

a first blade;

a second blade pivotally secured to the first blade;

a female connecting portion in the form of an elastic clamping piece having a dovetail slot, said dovetail slot including a bottom, first and second sides, and an elastic press portion at each of the first and second sides of the dovetail slot, said female connecting portion disposed on at least one of the first and second blades, each of the first and second sides of the dovetail slot having an edge distal to the bottom, said edges of the first and second sides extending parallel to an extending direction of the dovetail slot, wherein the first and second sides of the dovetail slot of the female connecting portion are biased from an open position towards a normal position, wherein the edges of the first and second sides of the dovetail slot have a greater spacing in the open position than in the normal position, wherein the elastic press portions of the female connecting portion is connected to the edges of the first and second sides and extending outwardly from the edges of the first and second sides of the dovetail slot, said elastic portions of the female connecting portion adjusting the size of the dovetail slot of the female connecting portion; and a male connecting portion disposed on at least one of the first and second blades, the male connecting portion having dovetail cross sections conforming to the dovetail slot of the female connecting portion and allowing sliding movement of the male connecting portion in the dovetail slot of the female connecting portion in the extending direction of the dovetail slot, said male connecting portion of said pair of scissors being releasably engaged with a dovetail slot of a female connecting portion of a pair of similarly constructed hairdressing scissors by either inserting the male connecting portion of the pair of hairdressing scissors into the dovetail slot of the female connecting portion of the pair of similarly constructed hairdressing scissors in the extending direction of the dovetail slot of the female connecting portion of said pair of-hairdressing scissors, or by pressing the elastic press portions of said pair of similarly constructed hairdressing scissors to move the dovetail slot of said pair of similarly constructed hairdressing scissors to the open position and then inserting the male connecting portion of said pair of hairdressing scissors into the dovetail slot of the female connecting portion of said pair of similarly constructed hairdressing scissors in the direction perpendicular to the extending direction of the dovetail slot of the female connecting portion of said pair of hairdressing scissors.

2. The pair of hairdressing scissors as claimed in claim 1, wherein the female connecting portion and the male connecting portion are two independent parts separate from each other and are disposed at two opposite surfaces of at least one of the first and second blades.

3. The pair of hairdressing scissors as claimed in claim 1, wherein the female connecting portion and the male connecting portion are integral with each other so as to form an unitary connecting member, and wherein on at least one of the first and second blades is formed a hole for accommodation of the unitary connecting member, and the female connecting portion and the male connecting portion are disposed at two opposite surfaces of at least one of the first and second blades, respectively.

4. The pair of hairdressing scissors as claimed in claim 1, wherein the female connecting portion is made of flexible elastic metal for adjusting the size of the dovetail slot of the female connecting portion.

* * * * *